US006571435B2

(12) United States Patent
Jain et al.

(10) Patent No.: US 6,571,435 B2
(45) Date of Patent: Jun. 3, 2003

(54) SEAT BELT BUCKLE WITH CONTROLLED TONGUE ENTRY

(75) Inventors: Tony Jain, Rochester Hills, MI (US); Antony W. Chamings, Oxford, MI (US); Rudi Grzic, Sterling Heights, MI (US); Stephan F. Vetter, St. Clair, MI (US)

(73) Assignee: Breed Automotive Technology, Inc., Lakeland, FL (US)

( * ) Notice: Subject to any disclaimer, the term of this patent is extended or adjusted under 35 U.S.C. 154(b) by 0 days.

(21) Appl. No.: 09/850,987

(22) Filed: May 8, 2001

(65) Prior Publication Data

US 2002/0166216 A1 Nov. 14, 2002

(51) Int. Cl.[7] ..... A44B 11/26
(52) U.S. Cl. ..... 24/651; 24/641
(58) Field of Search ..... 297/468; 280/801.1; 24/633–642, 651

(56) References Cited

U.S. PATENT DOCUMENTS 4,454,634 A * 6/1984 Haglund et al.
4,685,177 A * 8/1987 Escaravage
4,703,542 A * 11/1987 Hirata et al.
5,014,401 A * 5/1991 Kitazawa
5,067,212 A * 11/1991 Ellis
5,752,299 A * 5/1998 Vivacqua et al.
6,055,708 A * 5/2000 Ellis et al.
6,202,269 B1 * 3/2001 Specht et al.

FOREIGN PATENT DOCUMENTS

JP 2000041709 A * 2/2000 ..... A44B/11/26

* cited by examiner

*Primary Examiner*—James R. Brittain
(74) *Attorney, Agent, or Firm*—Markell Seitzman

(57) ABSTRACT

A seat belt buckle assembly including a seat belt buckle, the buckle including: a frame (26) defining a tongue-receiving slot (40); a latch plate (34) operably positioned in relation to the tongue-receiving slot and movable between an unlocked position and a locked position; a latch spring (64) for biasing the latch plate toward the locked position; an ejector mechanism (28) located behind the tongue-receiving slot and rearwardly movable in response to inward movement of a tongue; the ejector including a first portion engageable by the tongue and rearwardly movable to a position beyond the location of the latch plate and a second portion (80) slidably receiving and supporting the latch plate, the second portion remaining in contact with the latch plate, preventing the latch plate from moving to its locked position even when the first portion has moved beyond the latch plate.

6 Claims, 4 Drawing Sheets

SEAT BELT BUCKLE WITH CONTROLLED TONGUE ENTRY

BACKGROUND AND SUMMARY OF THE INVENTION

The invention generally relates to seat belt buckles.

Reference is briefly made to FIG. 1, which illustrates a prior art seat belt buckle 20 and interlocking tongue 22. The typical seat belt buckle 20 includes a cover 24 that may include top and bottom cover portions 24*a* and 24*b* suitably interconnected, a frame 26 and ejector 28 that is typically spring loaded by an ejector spring 30. The buckle additionally includes a manually operable button 32 that is guided by portions of the frame. The frame additionally includes one or more latch-receiving slots or openings such as 35, as well as a latch (latch mechanism) such as a latch plate 34 that is slidably (or rotatably) supported within the frame 26. The tongue 22 is received within an entry slot or channel 40 defined by portions of the frame. Extreme inward motion of the tongue pushes the ejector 28 rearwardly against the bias of its spring 30. When the ejector is moved sufficiently rearward, see dimension "a", the latch moves, or is forced to move, to its locked position within the latch receiving opening or openings 35 and within a latch-receiving opening 42 in the tongue. The latch can be moved to its released or unlocked position in response to the inward motion of the button. Once the latch disengages with the opening 42 in the tongue, the spring-loaded ejector pushes the tongue out of the buckle.

As can be seen in the various figures, the latch-receiving opening 42 is formed in the frame or latch plate 43 portion of the tongue and is positioned behind an integral bar or crosspiece 44 of the tongue. When the tongue is inserted in the buckle a distance greater than the length b of bar 44 (see FIG. 1), the latch 34 will move into the latch-receiving opening 42 of the tongue.

As mentioned above, the frame provides an entry slot or channel 40 for the tongue. Additionally, the buckle cover is also spaced from the frame; consequently, it might be possible to insert the forward tip portion of the tongue 22 in between the frame and the lower portion 24*b* of the cover. Numeral 50 designates the spacing between the frame and the lower portion of the cover. Continued, inward motion of the tongue may place the tongue against a portion of the ejector 28 moving the ejector rearwardly. If the rearward motion of the ejector exceeds dimension, a, the latch 34 will fall through the latch-receiving spaces or openings 35 (in the frame) even though the tongue is not in a position to lockingly receive the latch 34. The buckle of FIG. 1 might also be prone to tampering as an individual may insert an object such as a paper clip or screwdriver into the slot 40. Sufficient rearward movement of the inserted object will push the ejector rearward allowing the latch mechanism 34 to drop into the slots 35. With the latch in its lowered position, the tongue 22 can still be inserted within the slot 40, but the tongue will not lock with the latch 34. The vehicle occupant may not be aware that the tongue is not properly secured by the buckle latch.

It is an object of the present invention to provide a buckle that prevents the latch from moving to its locked position in response to a relatively small rearward motion of the ejector while not requiring excessive movement.

Accordingly the invention comprises: a seat belt buckle assembly including a seat belt buckle, the buckle comprising: a frame defining a tongue-receiving slot; a latch plate operably positioned in relation to the tongue-receiving slot and movable between an unlocked position and a locked position; a latch spring for biasing the latch plate toward the locked position; an ejector mechanism located behind the tongue-receiving slot and rearwardly movable in response to inward movement of a tongue; the ejector mechanism including a first portion engageable by the tongue and rearwardly movable to a position beyond the location of the latch plate and a second portion slidably receiving and supporting the latch plate, the second portion remaining in contact with the latch plate, preventing the latch plate from moving to its locked position even when the first portion has moved beyond the latch plate.

Many other objects and purposes of the invention will be clear from the following detailed description of the drawings.

DETAILED DESCRIPTION OF THE DRAWINGS

Figure 1:
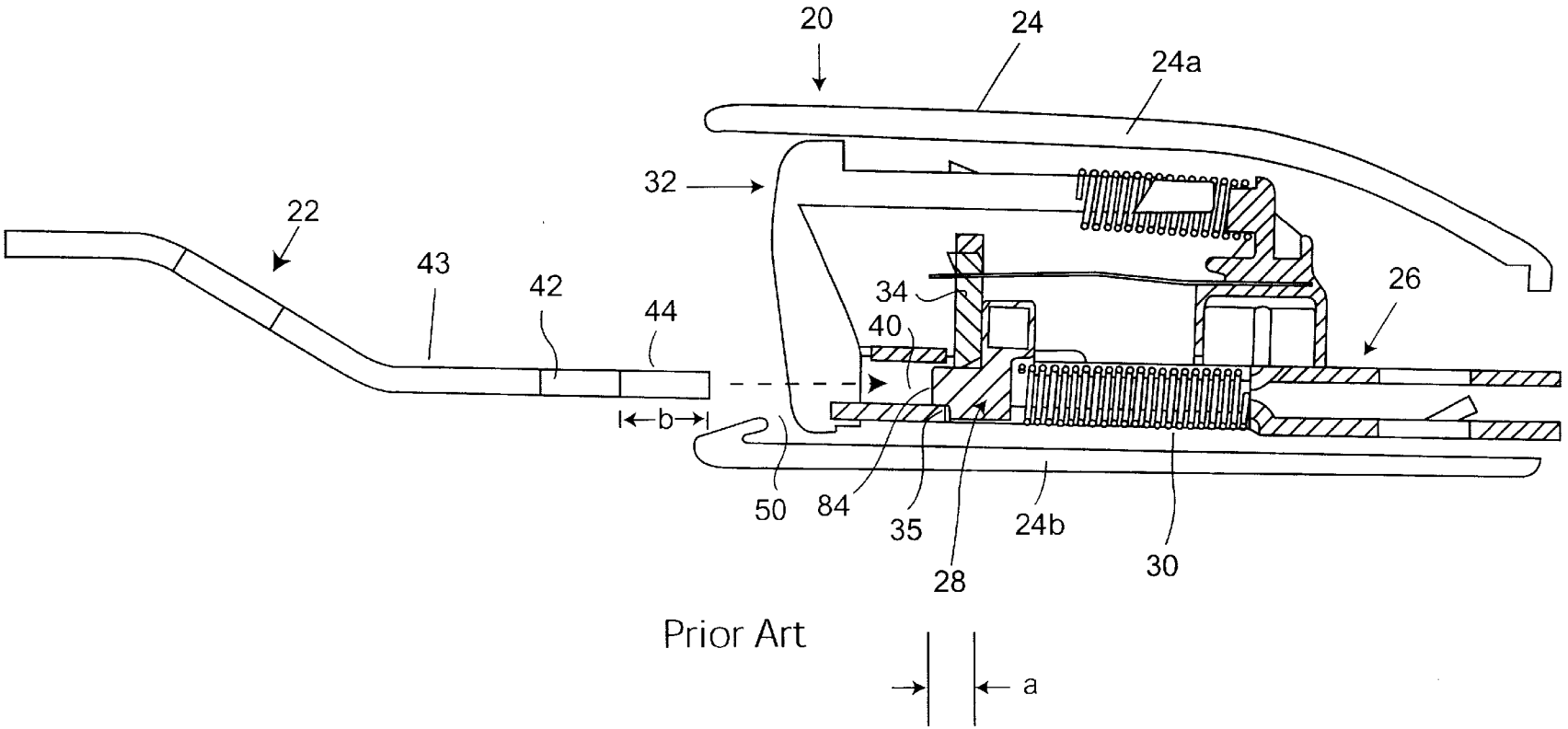
FIG. 1 diagrammatically illustrates a prior art seat belt buckle and mating tongue.
Figures 2, 5:
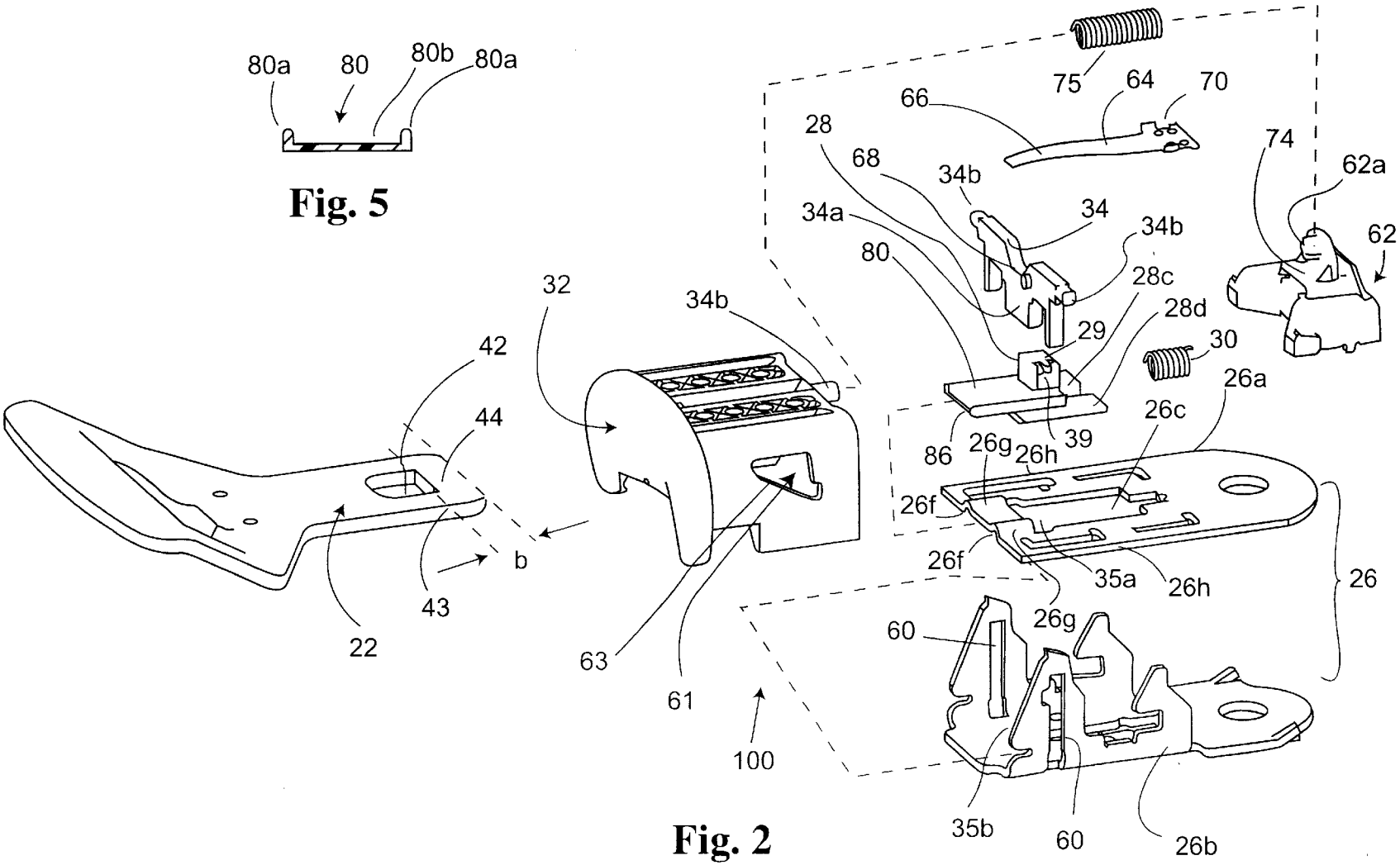
FIG. 2 illustrates an assembly view showing the major portions of a seat belt buckle that incorporates the present invention.
FIG. 5 show features of an ejector.

Reference is made to FIGS. 2–6, which illustrate the major components of a buckle 100 that incorporates the present invention. As can be appreciated, the present buckle also includes many of the components found in the prior art buckle of FIG. 1. The buckle 100 is also adapted to receive the tongue 22. As with the prior art, buckle 100 will also include a button 32, a frame 26 having one or more frame portions such as portions 26*a* and 26*b* and an ejector mechanism 28, an ejector spring 30, and a latch mechanism or latch such as a plate 34 that is guidably moveable within slots 60 within the frame 26. The latch, in its locked condition, is received within at least one latch-receiving opening 35*a* and 35*b* in the upper and lower frame pieces. In the illustrated embodiment, the latch 34 includes a center latch or locking part 34*a*, which fits within the latch-receiving openings 35*a* and 35*b* and is also received within the latch receiving opening 42 of the tongue 22. The latch 34 additionally includes a guidance mechanism, which guides the latch 34 into the openings 35*a* and 35*b*. In this embodiment, the latch includes ends or wings 34*b* that are received within a corresponding vertical slot 60 in a frame part. In addition, these wings extend laterally outward from the frame 26 and are received within a corresponding profiled slot 61 in each side of the button in a known manner. The inward motion of the button causes a ramp surface 63 of each slot 61 to lift a corresponding wing, moving the latch to its release position. The buckle also includes a spring housing 62 received upon the upper frame part 26*a*. The spring housing includes or supports a leaf spring 64, an end 66 of which is in engagement with a center top surface 68 of the latch plate 34. End 70 of the spring is secured to or molded within a medial portion 74 of the spring housing 62. As also shown in FIG. 5, the ejector 28 includes a forwardly extending plastic plate 80. The plate includes upraised sides 80*a* and a flat middle portion 80*b*. The metal center 34*a* of the latch slides upon this low-friction middle portion 80*b* of the plate 80. A lower portion of the ejector 28 is captured between the frame parts 26*a* and 26*b* and more particularly, a vertically extending portion 29 of the ejector rides within a slot 26*c* of the upper frame part. The slot 26*c* stabilizes the ejector. The ejector also includes wings 28*c, d*, which are spaced relative to the plate 80 and which slide on an undersurface of the upper frame part adjacent the opening 26*c*. If desired, the vertically extending portion 29 can be hollow so as to receive one of a Hall effect sensor, reed switch, micro-switch or magnet 39 that can be used to provide a signal indicating that the tongue is latched within the buckle and in particular the center portion 34*a* has moved to its locked position. The other of the Hall effect sensor, reed switch or magnet can be located elsewhere in the buckle to sense movement of the latch 34, ejector 28 or tongue 22.

Each upraised portion 80*a* of the plate or extension 80 of the ejector 28 is received within a corresponding slot 26*f* formed by upraised or bent portions 26*g* of the frame. The slots 26*f* prevent the front of the plate 80 of the ejector from moving sideways and also serve to stiffen the frame. As with most buckles, buckle 100 also includes a button spring 75 received on posts 34*b* and 62*a* of the spring housing 62.

Figure 3:
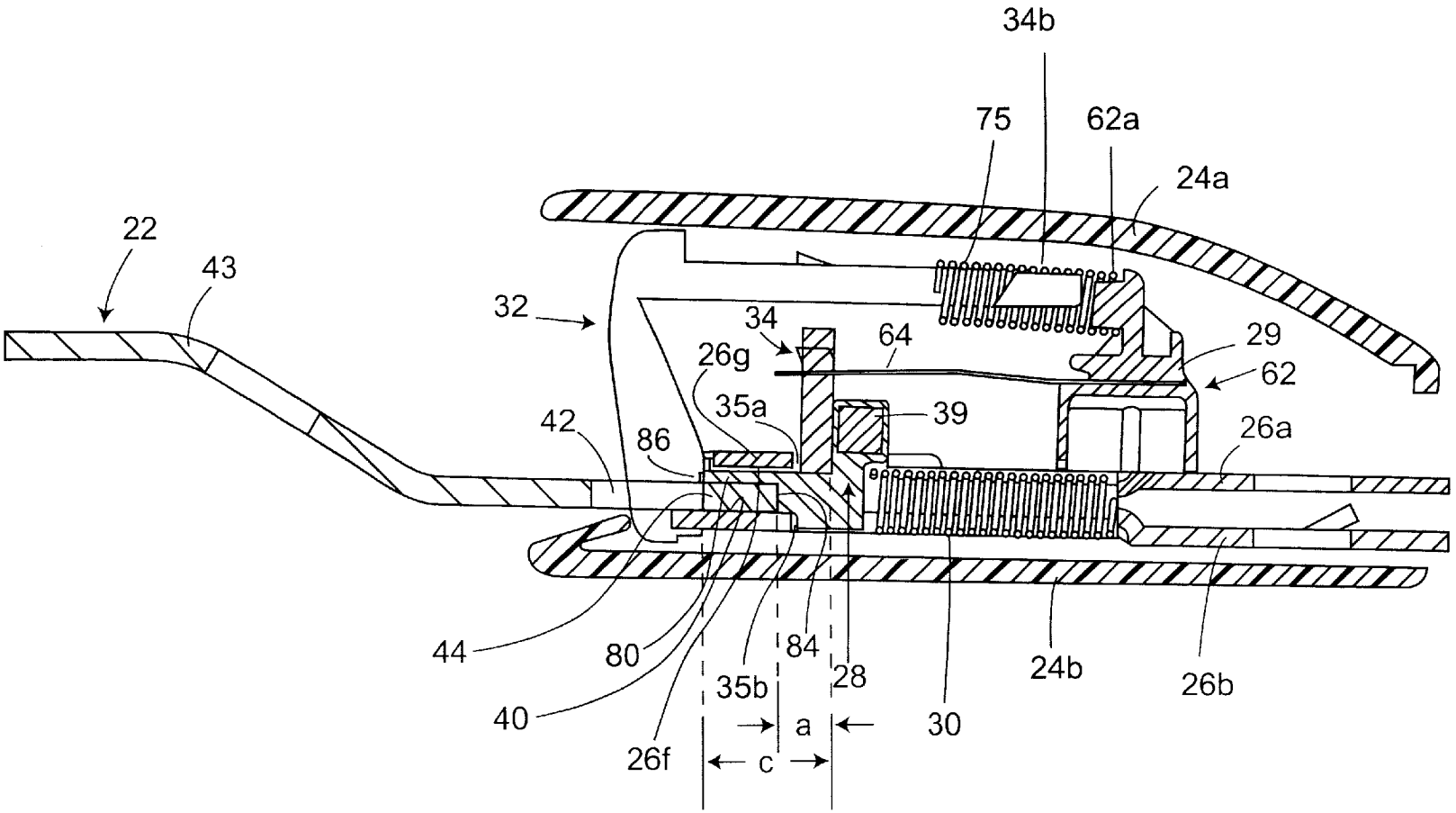
FIG. 3 is a cross-sectional view of the buckle showing its latch member in an unlocked position.
Figure 4:
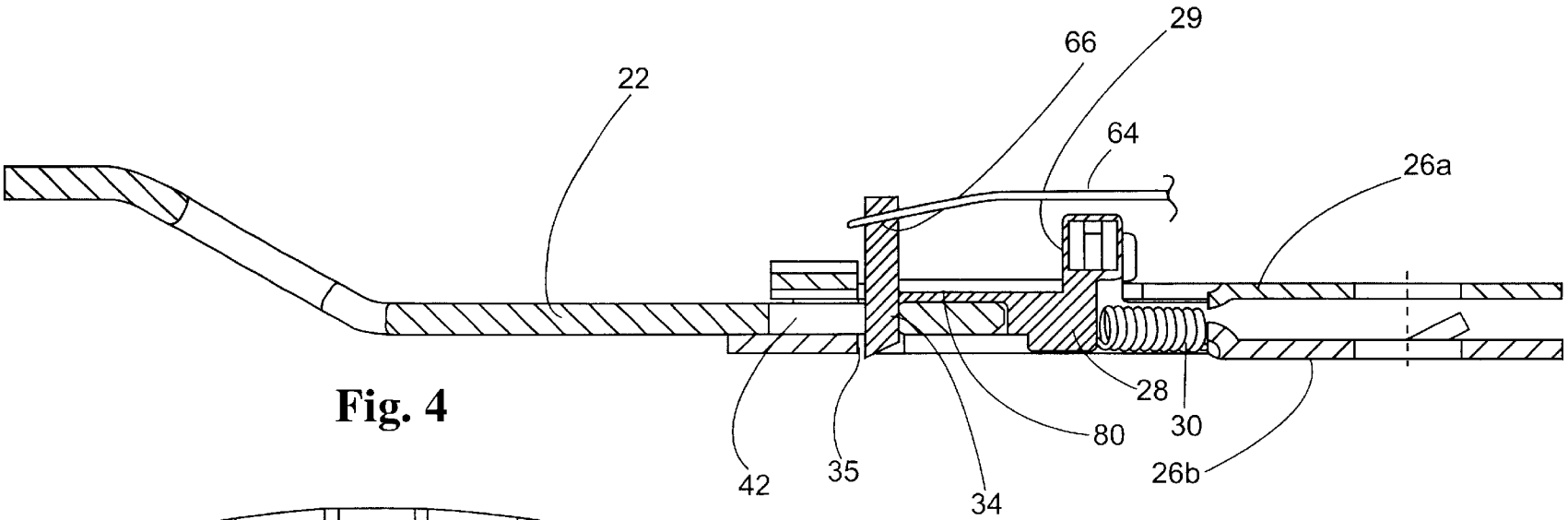
FIG. 4 is a cross-sectional view of the buckle showing its latch member in a locked position; the spring housing and cover have been removed.
Figure 6:
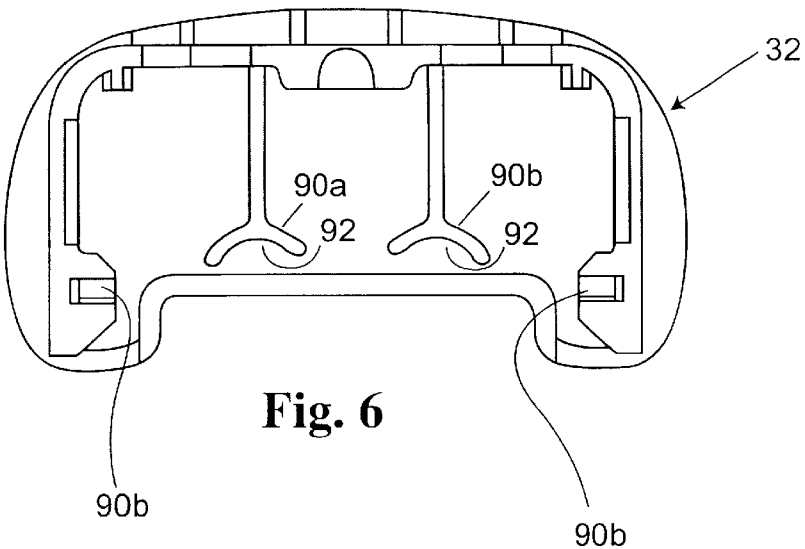
FIG. 6 is a rear plan view showing features within the hollow button.

In FIG. 3, the tongue 22 has been positioned within the entry slot 40 and is in slight abutment with a shoulder 84 of the ejector 28, which corresponds to the front face of the ejector 28 of FIG. 1. The ledge or plate 80 of the ejector extends forwardly from the shoulder 84 of ejector 28 in opposition to the direction of insertion of the tongue. The length of the plate 80 is chosen to cover the entire forward, tip portion or bar 44 of the tongue. One of the advantages of this construction in comparison with the prior art is that as the tongue is inserted in the buckle, the typical metal latch plate 34 no longer rides on the chrome-plated tongue 22 but on a lubricious plastic part 80, thereby avoiding scratching and pitting and reduces insertion friction. The forward tip 86 of the plate 80 can be sized to extend slightly beyond the tip or front bar 44 of the tongue so that it extends slightly over the opening 42 insuring that when the buckle latch 34 moves into its locked position (see FIG. 4), the opening of the tongue has already moved beyond the location of the latch. As mentioned above in relation with FIG. 1, if a foreign object is inserted into the buckle it only has to move the ejector a distance "a" to cause the latch to be moved to its lock position. While the present invention does not prevent tampering with the buckle, it does require that the ejector be moved a significantly longer distance before the latch can fall to its locked position (without a tongue in the slot 40). The same benefit is true if the tongue could somehow be inserted between the lower housing portion 26*b* and the lower cover portion 24*b*, that is with the introduction of the plate 80, the rearward ejector motion must now exceed the length of the plate. Reference is briefly made to FIG. 6, which illustrates an end view of the button 32. A portion of the button within its hollow center can be seen. More particularly, the button 32 includes two guides 90*a* and *b*. Each guide includes a curved surface 92, which rides upon the top of that portion 26*g* of the frame that forms the channels 26*f*. This interrelationship further laterally stabilizes the button from sidewards motion. The button also includes another set of grooves 90*b*. Each groove 90*b* slidably receives an edge portion 26*h* of the upper frame.

Many changes and modifications in the above-described embodiment of the invention can, of course, be carried out without departing from the scope thereof. Accordingly, that scope is intended to be limited only by the scope of the appended claims.

What is claimed is:

1. A seat belt buckle assembly including:

a seat belt buckle, the buckle comprising:

a frame (26) defining a tongue-receiving slot (40);

a latch plate (34) operably positioned in relation to the tongue-receiving slot and movable between an unlocked position and a locked position;

an ejector mechanism (28) includes a plate having upraised sides (80*a,b*);

wherein the frame (26) includes corresponding channels (26*f*) spaced from sides of the frame through which a corresponding upraised side slides.

2. The assembly as defined in claim 1 including a tongue (22) having a tip portion (44) of determinable length and an opening (24) for receiving the latch plate.

3. The assembly as defined in claim 2 wherein the length of the second portion of the ejector mechanism is equal to the length of the tip portion.

4. The assembly as defined in claim 2 wherein the length of the second portion of the ejector mechanism is slightly longer than the length of the tip portion.

5. The assembly as defined in claim 1 including a button slidably supported on the frame, the button includes arcuate supports that are adapted to slide on those portions of the frame that form the channels.

6. The assembly as defined in claim 1 including:

the buckle includes a latch spring (64) for biasing the latch plate toward the locked position; and wherein the ejector mechanism (28) is located behind the tongue-receiving slot and rearwardly movable in response to inward movement of a tongue; the ejector mechanism including a first portion engageable by the tongue; the ejector rearwardly movable to a position beyond the location of the latch plate and a second portion (80) slidably receiving and supporting the latch plate, the second portion remaining in contact with the latch plate, preventing the latch plate from moving to its locked position even when the first portion has moved beyond the latch plate.

* * * * *